United States Patent [19]

Halldorson et al.

[11] 4,225,094

[45] Sep. 30, 1980

[54] SLURRYING APPARATUS INCLUDING GRINDING AND SEPARATING MEANS

[76] Inventors: Jacob T. Halldorson, 53 Flagstone Crescent, St. Albert, Alberta; Rene Bureaud, 6508 - 109B Ave., Edmonton, Alberta, both of Canada

[21] Appl. No.: 6,810

[22] Filed: Jan. 25, 1979

[30] Foreign Application Priority Data

May 30, 1978 [GB] United Kingdom ..... 3914/78

[51] Int. Cl.[3] ..... B02C 17/06; B02C 17/22

[52] U.S. Cl. ..... 241/79; 241/177; 241/178; 241/182; 241/183

[58] Field of Search ..... 241/79, 171, 176, 177, 241/178, 179, 181, 182, 183

[56] References Cited

U.S. PATENT DOCUMENTS

| | | | |
|---|---|---|---|
| 1,591,703 | 7/1926 | Greenfield | 241/178 |
| 1,772,737 | 8/1930 | Wise et al. | 241/177 |
| 3,185,192 | 5/1965 | Delcellier | 241/178 X |
| 3,586,249 | 6/1971 | Fagerholt | 241/176 X |
| 3,633,832 | 1/1972 | Fagerholt | 241/176 X |
| 4,018,567 | 4/1977 | La Point | 241/77 X |

*Primary Examiner*—Richard B. Lazarus

*Attorney, Agent, or Firm*—Shlesinger, Arkwright, Garvey and Dinsmore

[57] ABSTRACT

According to the present invention there is provided slurrying apparatus comprising a rotatable drum arranged for rotation about its longitudinal axis and including a slurrying chamber portion so arranged that when the drum is rotated feed material passes from an inlet of the slurrying chamber portion to a discharge chamber portion of the drum in which slurry and fine particles are separated from coarser particles and are discharged separately, and rotation means for causing rotation of the drum.

14 Claims, 15 Drawing Figures

SLURRYING APPARATUS INCLUDING GRINDING AND SEPARATING MEANS

BACKGROUND OF THE INVENTION

This invention relates to slurrying apparatus suitable for slurrying a feed liquid and a solid such as the bituminous sand containing hydrocarbons that is currently being mined in the Athabasca area of Alberta, Canada.

Hydrocarbons can conveniently be extracted from bituminous sand by techniques that utilize the special and possibly unique conditions existing in the sand. Although the interstices of the sand are largely filled with oil, the individual grains of sand are separated from the oil by a minute film of water. Because the water is in intimate contact with the sand grains and prevents the bitumen from adhering to the sand grains, bitumen and sand can be separated by tumbling with hot or even cold water and the thus separated bitumen treated by suitable hydrocarbon extraction processes.

DESCRIPTION OF THE PRIOR ART

Various tumbling apparatuses are known for comminuting and disintegrating materials utilizing a rotatable drum tumbler having internal means to pulverize, grind or treat raw material.

For example, U.S. Pat. No. 634,254 discloses a drum separated into two sections by a screen. Material fed into the first section is "coarse" ground by the action of large diameter steel balls as the drum rotates and the reduced material then passes through the screen into the second chamber which contains steel balls of a smaller diameter which reduce the material to a fine degree.

Further, U.S. Pat. No. 1,075,707 discloses a pulverizing mill comprising an inclined rotatable drum having a series of fixed steel rolls of various diameters extending the length of the drum and positioned such that a number of the rolls roll in contact with the inner surface of the drum, adjacent rolls being held out of contact with each other, a number of smaller diameter rolls being arranged to roll in contact with two of the first mentioned rolls, but being held out of contact with each other. Material passing through the drum is thereby crushed to a fine degree by this rolling action.

In addition, U.S. Pat. No. 2,450,980 discloses a rotating drum scrubber for removing dirt from aggregates such as sand and gravel, the drum including a number of vanes, pitched with respect to the plane of rotation of the drum, to advance a slurry therethrough. High pressure water is continually flushed through the drum, and the vanes separate the aggregate into coarse and fine fractions which are discharged separately for further processing.

BRIEF SUMMARY OF THE INVENTION

According to the present invention there is provided slurrying apparatus comprising a rotatable drum arranged for rotation about its longitudinal axis and including a slurrying chamber portion so arranged that when the drum is rotated feed material passes from an inlet of the slurrying chamber portion to a discharge chamber portion of the drum in which slurry and fine particles are separated from coarser particles and are discharged separately, and rotation means for causing rotation of the drum.

Such apparatus can be used, for example, for slurrying and tumbling bitumen sand with water so as to form a dispersion prior to separation of the hydrocarbons. In addition, the apparatus of the invention desirably serves to separate and subsequently extract from the slurry any foreign bodies that would otherwise complicate a subsequent hydrocarbon extraction process.

Preferably, the material slurrying chamber portion is adapted to grind or pulverize material and is internally lined with a plurality of plate assemblies comprising scoops and comminuting bars, the bars forming a grid matrix spaced inwardly from the internal wall of the drum. A feed hopper is conveniently provided at the inlet end of the drum by which feed material may be introduced to the slurrying chamber portion. Material so fed is initially separated by the grid arrangement, the fine solids passing between the bars and the larger solids and foreign bodies remaining supported thereby. In preferred arrangements slurry lifting means and primary and secondary discharge chambers cooperate to effect the separate discharge of fine slurried solids, and foreign matter from the apparatus.

BRIEF DESCRIPTION OF THE DRAWINGS

A preferred embodiment of the invention will now be described, by way of example, with reference to the accompanying drawings, in which.

DETAILED DESCRIPTION OF THE PREFERRED EMBODIMENT(S)

Figure 1:
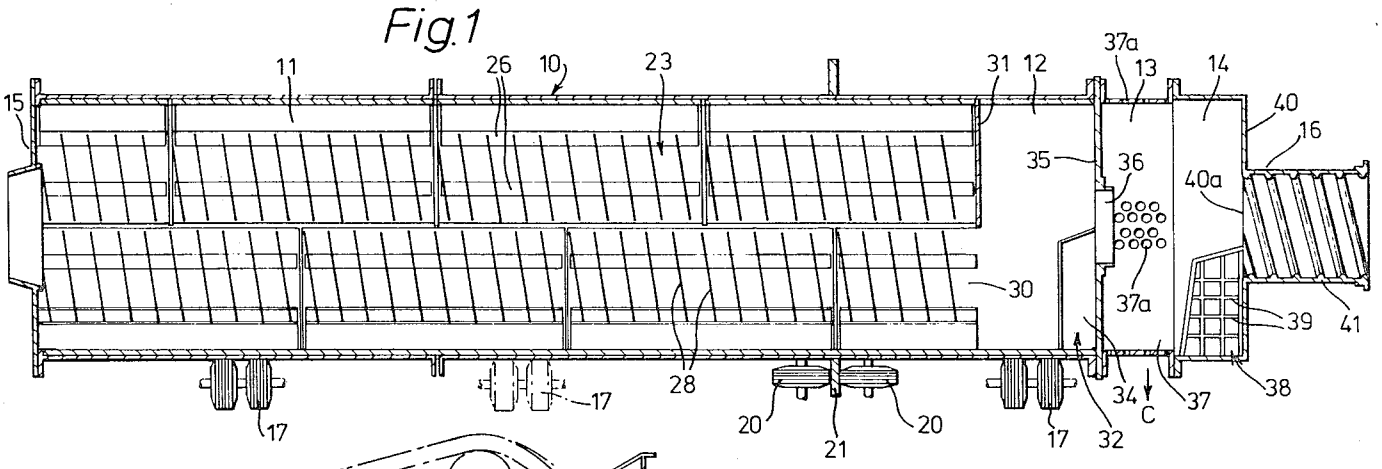
FIG. 1 is a vertical longitudinal section of apparatus according to the invention and including a slurrying chamber, a slurry lifting chamber and primary and secondary slurry discharge chambers.
Figure 3:
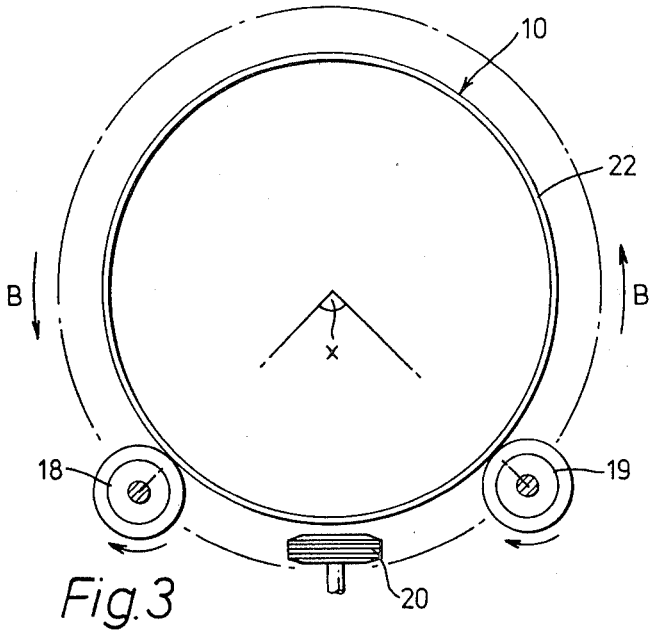
FIG. 3 is a schematic transverse vertical section of the apparatus of FIG. 1, showing external supporting and driving components, the internal components of the apparatus being omitted.

Referring to the drawings, the illustrated slurrying apparatus which, for simplicity, will be referred to hereafter as a "tumbler" comprises an elongate drum 10 which in this embodiment is divided into four chambers: material slurrying chamber 11; a slurry lifting chamber 12; a primary discharge chamber 13 and a secondary discharge chamber 14. The tumbler is preferably mounted for rotation about a plane that is slightly inclined with respect to the horizontal so as to initiate and assist the flow of material from inlet end 15 of the tumbler to the discharge end 16 thereof. It is envisaged that the angle of inclination will be in the region of 1°-5°, suitable means described below being provided to enable adjustment of this angle. As shown in FIGS. 1 and 3, the drum 10 is rotatably supported by a plurality of rubber tire wheel assemblies 17 each assembly including a drive wheel 18 and an idler wheel 19 and being arranged to cause rotation of the drum 10 in the direction indicated by arrows B. To prevent longitudinal movement of the rotating drum 10, a pair of guide wheels 20 are utilized which rotatably bear against a guide ring, or flange 21 of shell 22 of drum 10 as it rotates.

Considering the internal configuration of drum 10, the components utilized in chamber 11 will now be described, reference being made to FIGS. 1, 4, 7, 8 to 12 and 13.

Figure 4:
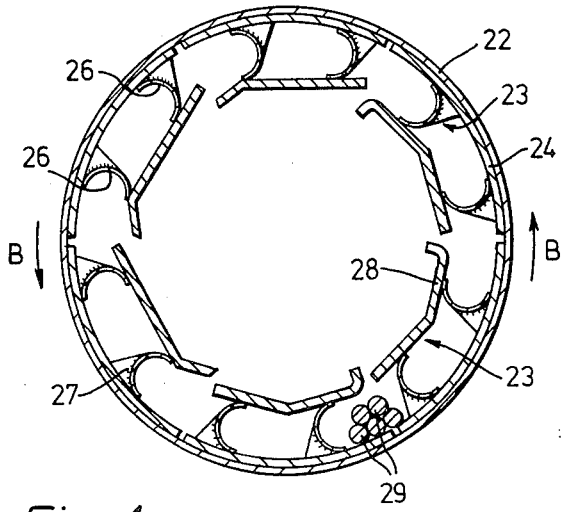
FIG. 4 is a schematic transverse vertical section through the slurrying chamber of the apparatus of FIG. 1.
Figure 8:
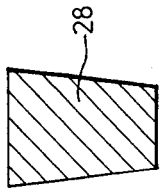
FIG. 8 is an enlarged scale cross-sectional view of a comminuting bar.
Figure 9:
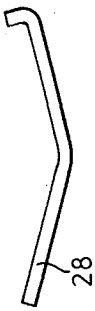
FIG. 9 is a side elevational view of a preferred form of comminuting bar.
Figure 10:
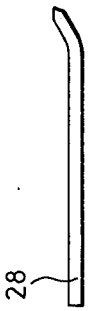
FIG. 10 is a side elevational view of an alternative form of comminuting bar.
Figure 7:
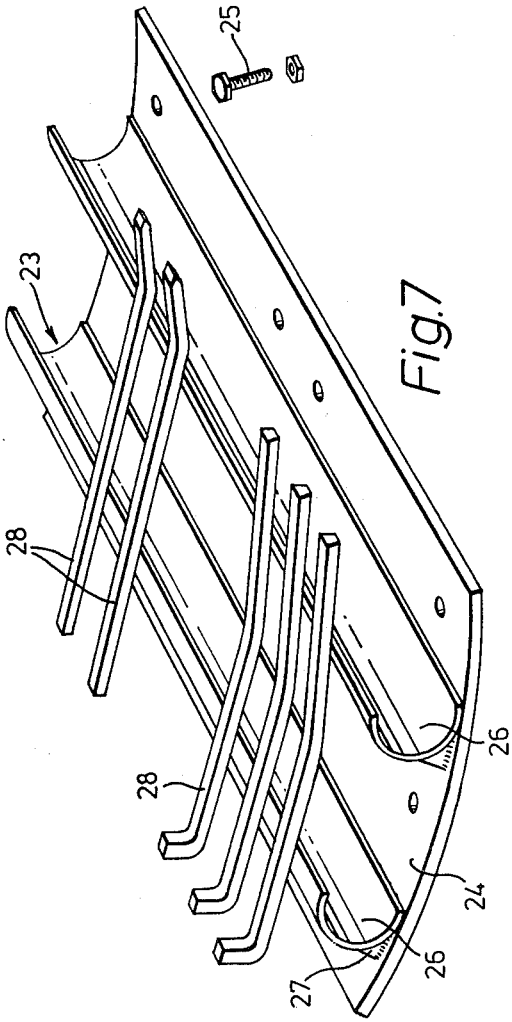
FIG. 7 is a perspective view of a liner plate assembly, showing two alternative types of comminuting bars.
Figure 12:
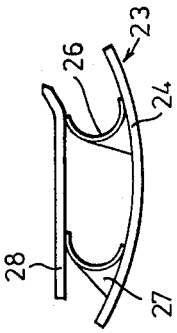
FIG. 12 is a side slevational view of a liner plate assembly provided with the comminuting bar of FIG. 10.
Figure 11:
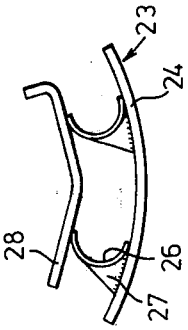
FIG. 11 is a side elevational view of a liner plate assembly provided with the comminuting bar of FIG. 9.
Figure 13:
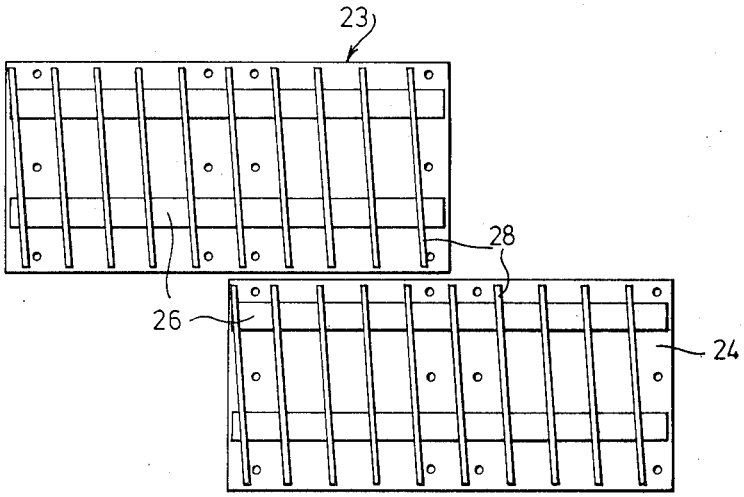
FIG. 13 shows schematically the manner in which liner plate assemblies are located on the inner surface of the material slurrying chamber.

As best shown in FIG. 4, the internal surface of shell 22 is provided with a plurality of liner plate assemblies 23, one such assembly being shown in FIG. 7. Each assembly 23 comprises a base plate 24 adapted to be bolted to shell 22 by a number of bolts 25. Plate 24 is curved so as to conform with the curvature of shell 22. On each base plate 24 are positioned at least two spaced, axially extending arcuate scoops 26, the scoops being welded to plate 22 and positioned by supports 27 such that the open end of each scoop is directed in the direction of rotation of the drum. To complete the assembly 23, a plurality of comminuting bars 28 are attached, for example by welding, to the scoops 26 to extend transversally with respect to the assembly and form a grid. These bars 28, which in the industry are generally called "grizly bars", are intended to assist in slurrying, and two alternative preferred forms of such bars are shown in FIGS. 7 and 9 to 12. A typical cross-section of such a bar 28 is shown in FIG. 8. It will be appreciated that either or both types of bars 28 may be utilized and need not necessarily be arranged as depicted in FIG. 4 or 7. To further assist flow of material through the drum 10, it is envisaged that these bars 28 may be set on various pitches ranging from negative to neutral to positive, to vary the rate of advance of material. Such variable orientation allows longer or shorter retention times of material to improve the attrition of, for example, lumps of ore in the feed solids. By causing the larger solids to be retained on the grid during rotation of the drum, such solids are subject to more attrition than the finer slurried solids which fall between the bars 28 and are carried within the space between adjacent scoops 26. Furthermore, it is preferred that successive rows of the assemblies are staggered relative to adjacent rows, as shown in FIGS. 1 and 13. Further, a plurality of loose grinding rods 29 are provided in the area between the adjacent scoops 26 (FIG. 4) for grinding material present in such areas.

Figure 5:
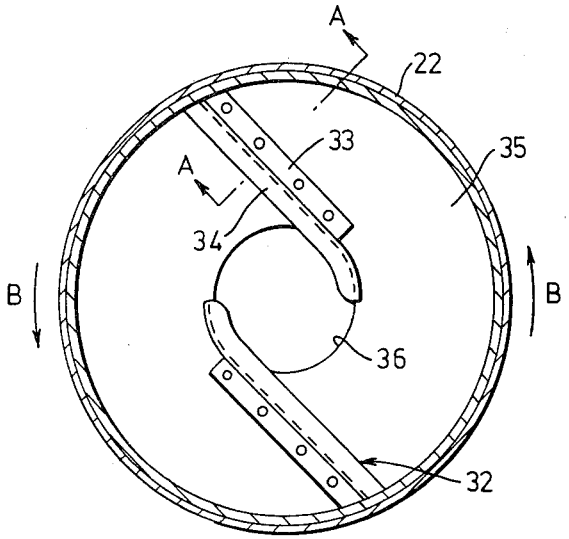
FIG. 5 is a schematic transverse vertical section through the slurry lifting chamber of the apparatus of FIG. 1.
Figure 5A:
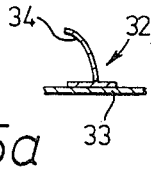
FIG. 5*a* is a fragmentary section on line A—A of FIG. 5.

Referring now to FIGS. 1, 5 and 5*a*, it can be seen that slurry lifting chamber 12 is an extension of chamber 11, but is not provided with liner plate assemblies 23. Chambers 11 and 12 are separated by a dividing wall 31 that is provided with an opening 30 to permit material to pass from chamber 11 to chamber 12. The purpose of chamber 12 is simply to lift the slurried material, and any foreign matter, and cause same to be passed into the primary discharge chamber 13. To facilitate lifting, in this embodiment, a pair of lifter assemblies 32 are provided, each comprising a base plate 33 and a lifting element 34 which has a scoop-like configuration. The assemblies 32 are fixedly attached to a wall 35 which separates chambers 12 and 13, the elements 34 being angled towards a central circular orifice or opening 36 in wall 35, i.e. extending from the inner surface of shell 22, in a direction tangential to opening 36.

As will be evident from FIG. 1, the primary discharge chamber 13 comprises a discharge screen 37 in the form of a circular cylinder, the screen including openings or mesh 37*a* of a predetermined size that permits only material of that size or less to pass therethrough. Chamber 13 opens onto the secondary discharge chamber 14 so that any particles retained by screen 37 pass from chamber 13 to chamber 14 and accumulate therein.

Figure 6A:
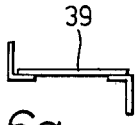
FIG. 6*a* is a side view of a detail of the material lifter shown in FIG. 6.
Figure 6:
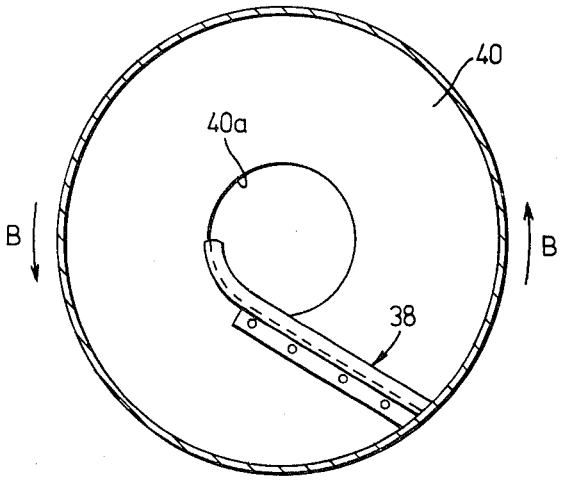
FIG. 6 is a schematic transverse vertical section through the secondary discharge chamber of the apparatus of FIG. 1, showing a material lifter.

Referring to FIGS. 1, 6 and 6*a*, chamber 14 is provided with a single material lifter 38 which may be of similar construction to the lifter 32 of chamber 12, but in this embodiment comprises a framework of spaced apart rods or bars 39, the spacings between adjacent rods being greater than the openings 37*a* of the discharge screen 37 in chamber 13. Lifter 32 is angularly positioned with respect to an opening 40*a* in an end wall 40 at the outlet end of the chamber so as to cause material lifted by lifter 38 to pass therethrough.

Finally, the tumbler is provided with a material outlet 41 which in this embodiment is a substantially horizontal tubular structure having an internal discharge scroll, the spiral configuration of which assist in ejecting the material from the tumbler.

The operation of the above described apparatus will now be discussed in connection with comminution and slurrying of bituminous sand.

Figure 2:
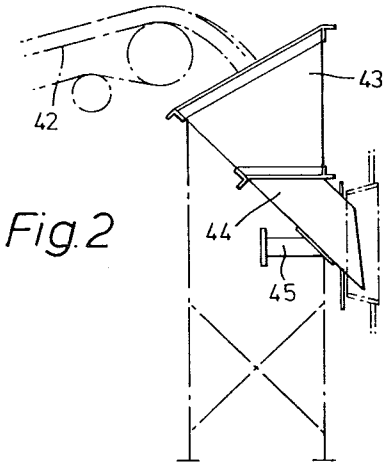
FIG. 2 is a side elevational view of a feed hopper adapted for attachment to the inlet end of the apparatus of FIG. 1.

Mined bituminous sand is fed via a conveyer system 42 into the hopper 43 of chute 44 attached to the inlet end 15 of drum 10 (FIG. 2). Hot or cold water under pressure is introduced through nozzle 45, mounted axially of the drum 10, to convert the mined material into a slurry within chamber 11. Total slurrying, as will be appreciated, may not be achieved in view of the constituency of the mined material, which will probably include unbroken pieces of ore, large rocks and stones which themselves may be coated with bitumen. As the mined material enters chamber 11, it will fall into bars 28, the larger pieces being supported by the bars, while the slurried material, including smaller ore pieces, will fall between the bars to be held initially in the area between adjacent scoops 26 and there to be further pulped by action of grinding rods 29. As the drum 10 rotates, the scoops 26 mechanically lift the slurried sand and small pebbles and empty same back into the central portion of chamber 11 to impinge upon the larger rocks and pieces of ore that are themselves tumbling around on top of the bars 28. By virtue of the bar configuration, the larger pieces of ore and the rocks are scrubbed by the tumbling action and additional scrubbing and ablation of the material resting on the bars is caused by the impingement of the smaller stones falling from the scoops. By controlling the pitch and offset of the comminution bars, the rate of advance of rocks can be controlled, and selected sizes can be advanced or retreated as desired.

In this manner, substantially all of the hydrocarbon deposit can be separated from the coarse ore. Eventually, the slurry and any remaining large rocks and stones still supported by the bars are deposited in chamber 12 and are lifted by lifters 32 into primary discharge chamber 13 through opening 36.

As will be evident, the slurry is rotated around chamber 13, and all slurried material, except the larger rocks and stones, will be discharged from chamber 13 in the direction of arrow C via the screen 37. The material thus removed is then passed for further processing to remove and subsequently upgrade the end product i.e. the hydrocarbons.

Again, as will be evident, the larger rocks and stones which remain in chamber 13 pass to chamber 14, where they are lifted and subsequently enjected from the apparatus.

As mentioned above, the inclination of drum 10 with respect to the horizontal is capable of adjustment to control the rate of flow of materials. In the present embodiment this can be readily achieved by moving the two wheel assemblies 17 nearest the inlet end of the apparatus towards or away from one another, i.e. increasing or decreasing angle x (FIG. 3).

Apparatus according to the invention also has application in the comminution of oil shale. Oil shale differs from bituminous sand in that it is a compact rock of sedimentary origin which contains organic matter that yields oil and gas on distillation. Oil shale, like bituminous sand, is mined and then broken down prior to distillation, again by a tumbling or comminuting process.

At the present time, the distillation process is only capable of handling coarse materials, all finely ground material is currently being stockpiled. While processes are available to handle the distillation of "fine" material, the cost is prohibitive. It will however be appreciated that modifications to the apparatus described herein could be made to utilize the tumbler for comminution of oil shale.

It will also be obvious to those skilled in the art, that the apparatus according to the invention has applicability in any process which requires that mined mineral materials be pulverized and/or slurried to assist in the extraction of specific mineral elements.

We claim:

1. A slurrying apparatus comprising a rotatable drum arranged for rotation about its longitudinal axis and including a slurrying chamber portion so arranged that when said drum is rotated, feed material passes from an inlet of said slurrying chamber portion to a discharge portion of said drum wherein slurry and fine particles are separated from coarser particles and are discharged separately, said slurrying chamber portion including means for grinding or pulverizing solid particles, said slurrying chamber portion being lined with a plurality of liner assemblies each including one or more scoops extending substantially parallel to the longitudinal axis of said drum, said scoops supporting one or more comminuting bars extending substantially transversely to said scoops and arranged to form a grid spaced inwardly from the internal surface of the drum, and means for causing rotation of said drum.

2. Apparatus according to claim 1, including a plurality of grinding bars disposed in the annular space between the internal surface of the drum and the comminuting bars, the grinding bars extending substantially parallel to the longitudinal axis of the drum.

3. Apparatus according to claim 1 wherein the open end of each scoop is directed in the direction of rotation of the drum.

4. Apparatus according to claim 1 wherein the comminuting bars are set on various pitches to vary the rate of advance of material along the slurrying chamber portion of the drum.

5. Apparatus according to claim 1 wherein the liner assemblies are arranged in staggered rows.

6. Apparatus according to claim 1 wherein the discharge chamber portion comprises a primary discharge chamber having a meshed external wall, and a secondary discharge chamber including lifting means arranged to lift particles retained by the meshed wall to a discharge outlet.

7. Apparatus according to claim 6, wherein the lifting means comprises a framework of spaced apart bars or rods and extends from adjacent to the internal surface of the drum to adjacent to the discharge outlet.

8. Apparatus according to claim 6 wherein the discharge outlet comprises a substantially horizontal tubular structure having an internal discharge scroll.

9. Apparatus according to claim 1 wherein the drum is arranged with its longitudinal axis inclined to the horizontal.

10. Apparatus according to claim 9 wherein the angle of inclination is in the range 1° to 5°.

11. Apparatus according to claim 1 including a plurality of drive wheels for causing rotation of the drum.

12. Apparatus according to claim 11, wherein the lateral spacing of a pair of adjacent drive wheels is adjustable to enable adjustment of the angle of inclination of the longitudinal axis of the drum with respect to the horizontal.

13. Apparatus according to claim 1 further comprising a hopper having an inlet chute leading to the inlet of the slurrying chamber portion.

14. Apparatus according to claim 1 further comprising a liquid inlet nozzle for introducing liquid to the slurrying chamber portion.

* * * * *